US010059547B2

(12) United States Patent
Hayashi et al.

(10) Patent No.: US 10,059,547 B2
(45) Date of Patent: Aug. 28, 2018

(54) SHEET FEEDER, AND METHOD AND COMPUTER-READABLE MEDIUM THEREFOR

(71) Applicant: BROTHER KOGYO KABUSHIKI KAISHA, Nagoya, Aichi (JP)

(72) Inventors: Masayoshi Hayashi, Aichi (JP); Yuji Hori, Gifu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/599,531

(22) Filed: May 19, 2017

(65) Prior Publication Data

US 2017/0341890 A1 Nov. 30, 2017

(30) Foreign Application Priority Data

May 26, 2016 (JP) ..... 2016-105284

(51) Int. Cl.

| | |
|---|---|
| ***B65H 9/12*** | (2006.01) |
| ***B65H 7/04*** | (2006.01) |
| ***B65H 7/12*** | (2006.01) |
| ***B65H 5/06*** | (2006.01) |
| *B65H 9/20* | (2006.01) |

(52) U.S. Cl.

CPC ..... *B65H 7/04* (2013.01); *B65H 5/06* (2013.01); *B65H 7/125* (2013.01); *B65H 9/20* (2013.01); *B65H 2511/524* (2013.01); *B65H 2553/30* (2013.01)

(58) Field of Classification Search

CPC .... B65H 7/125; B65H 9/20; B65H 2511/524; B65H 2553/30

See application file for complete search history.

(56) References Cited

U.S. PATENT DOCUMENTS

| | | | | |
|---|---|---|---|---|
| 6,831,875 | B2 * | 12/2004 | Arai | B65H 23/0204 367/124 |
| 7,357,306 | B2 * | 4/2008 | Ma | B65H 7/125 235/375 |
| 2004/0150155 | A1 | 8/2004 | Okitsu et al. | |
| 2005/0184453 | A1 * | 8/2005 | Sano | B65H 7/125 271/262 |

(Continued)

FOREIGN PATENT DOCUMENTS

| | | | |
|---|---|---|---|
| JP | 2004-231404 | A | 8/2004 |
| JP | 2009-161291 | A | 7/2009 |

(Continued)

*Primary Examiner* — Howard J Sanders

(74) *Attorney, Agent, or Firm* — Scully, Scott, Murphy & Presser, PC

(57) ABSTRACT

A sheet feeder includes a controller configured to control an emitter to emit an ultrasonic wave toward a target sheet being fed along a sheet guide, control a measurer to measure a first reception intensity of a first component of the ultrasonic wave received by a receiver during a first period of time, control the measurer to measure a second reception intensity of a second component of the ultrasonic wave received by the receiver during a second period of time, and determine a feeding state of the target sheet in a detectable area between the emitter and the receiver within the sheet guide, based on the first reception intensity and the second reception intensity.

13 Claims, 10 Drawing Sheets

(56) References Cited

U.S. PATENT DOCUMENTS

| | | | | |
|---|---|---|---|---|
| 2013/0098157 | A1 | 4/2013 | Suzuki | |
| 2016/0159597 | A1* | 6/2016 | Hayashi ..... | B65H 7/04<br>271/265.04 |

FOREIGN PATENT DOCUMENTS

| | | | |
|---|---|---|---|
| JP | 2010-095373 | A | 4/2010 |
| JP | 2013-090269 | A | 5/2013 |

* cited by examiner

SHEET FEEDER, AND METHOD AND COMPUTER-READABLE MEDIUM THEREFOR

CROSS-REFERENCE TO RELATED APPLICATION

This application claims priority under 35 U.S.C. § 119 from Japanese Patent Application No. 2016-105284 filed on May 26, 2016. The entire subject matter of the application is incorporated herein by reference.

BACKGROUND

Technical Field

The following description relates to aspects of a sheet feeder, and a method and a computer-readable medium therefor.

Related Art

Heretofore, a sheet feeder has been known that is configured to detect multi-feed in which multiple sheets are simultaneously fed in a mutually-overlapping manner, using an ultrasonic sensor. For instance, the known sheet feeder may detect the multi-feed by detecting a thickness of a sheet using the ultrasonic sensor and comparing a detected thickness value from the ultrasonic sensor with reference values. The reference values may include a reference value for detecting multi-feed and a reference value for detecting the sheet thickness.

SUMMARY

The known sheet feeder with the ultrasonic sensor may be capable of detecting the sheet thickness and multi-feed with the ultrasonic sensor. However, the known sheet feeder may have some difficulty in identifying various feeding states. For instance, the known sheet feeder may be configured to feed a thick plastic card as well as a thin regular paper, but the sheet feeder may mistakenly identify multi-feed of thin regular papers although actually feeding a thick plastic card. Moreover, such a known sheet feeder having the ultrasonic sensor may not be capable of determining a sheet size.

Aspects of the present disclosure are advantageous to provide one or more improved techniques, for a sheet feeder, which make it possible to discriminate various feeding states including multi-feed with an ultrasonic sensor.

According to aspects of the present disclosure, a sheet feeder is provided that includes a sheet guide, an emitter disposed to face a first side of a sheet being fed along the sheet guide, the emitter being configured to emit ultrasonic waves, a receiver opposed to the emitter across the sheet guide, the receiver being disposed to face a second side of the sheet being fed along the sheet guide, the second side being an opposite side of the first side, the receiver being configured to receive the ultrasonic waves, a measurer configured to measure reception intensities of the ultrasonic waves received by the receiver, and a controller configured to perform a state determining process. The state determining process includes controlling the emitter to emit an ultrasonic wave toward a target sheet being fed along the sheet guide, in response to the emission of the ultrasonic wave, controlling the measurer to measure a first reception intensity of a first component of the ultrasonic wave received by the receiver during a first period of time, controlling the measurer to measure a second reception intensity of a second component of the ultrasonic wave received by the receiver during a second period of time after the first period of time, and determining a feeding state of the target sheet in a detectable area between the emitter and the receiver within the sheet guide, based on the first reception intensity of the first component received during the first period of time and the second reception intensity of the second component received during the second period of time.

According to aspects of the present disclosure, further provided is a method implementable on a processor coupled with a sheet feeder including a sheet guide, an emitter, a receiver, and a measurer. The method includes controlling the emitter to emit an ultrasonic wave toward a target sheet being fed along the sheet guide, in response to the emission of the ultrasonic wave, controlling the measurer to measure a first reception intensity of a first component of the ultrasonic wave received by the receiver during a first period of time, controlling the measurer to measure a second reception intensity of a second component of the ultrasonic wave received by the receiver during a second period of time after the first period of time, and determining a feeding state of the target sheet in a detectable area between the emitter and the receiver within the sheet guide, based on the first reception intensity of the first component received during the first period of time and the second reception intensity of the second component received during the second period of time.

According to aspects of the present disclosure, further provided is a non-transitory computer-readable medium storing computer-readable instructions that are executable on a processor coupled with a sheet feeder including a sheet guide, an emitter, a receiver, and a measurer. The instructions are configured to, when executed by the processor, cause the processor to control the emitter to emit an ultrasonic wave toward a target sheet being fed along the sheet guide, in response to the emission of the ultrasonic wave, control the measurer to measure a first reception intensity of a first component of the ultrasonic wave received by the receiver during a first period of time, control the measurer to measure a second reception intensity of a second component of the ultrasonic wave received by the receiver during a second period of time after the first period of time, and determine a feeding state of the target sheet in a detectable area between the emitter and the receiver within the sheet guide, based on the first reception intensity of the first component received during the first period of time and the second reception intensity of the second component received during the second period of time.

BRIEF DESCRIPTION OF THE ACCOMPANYING DRAWINGS

Figure 5:
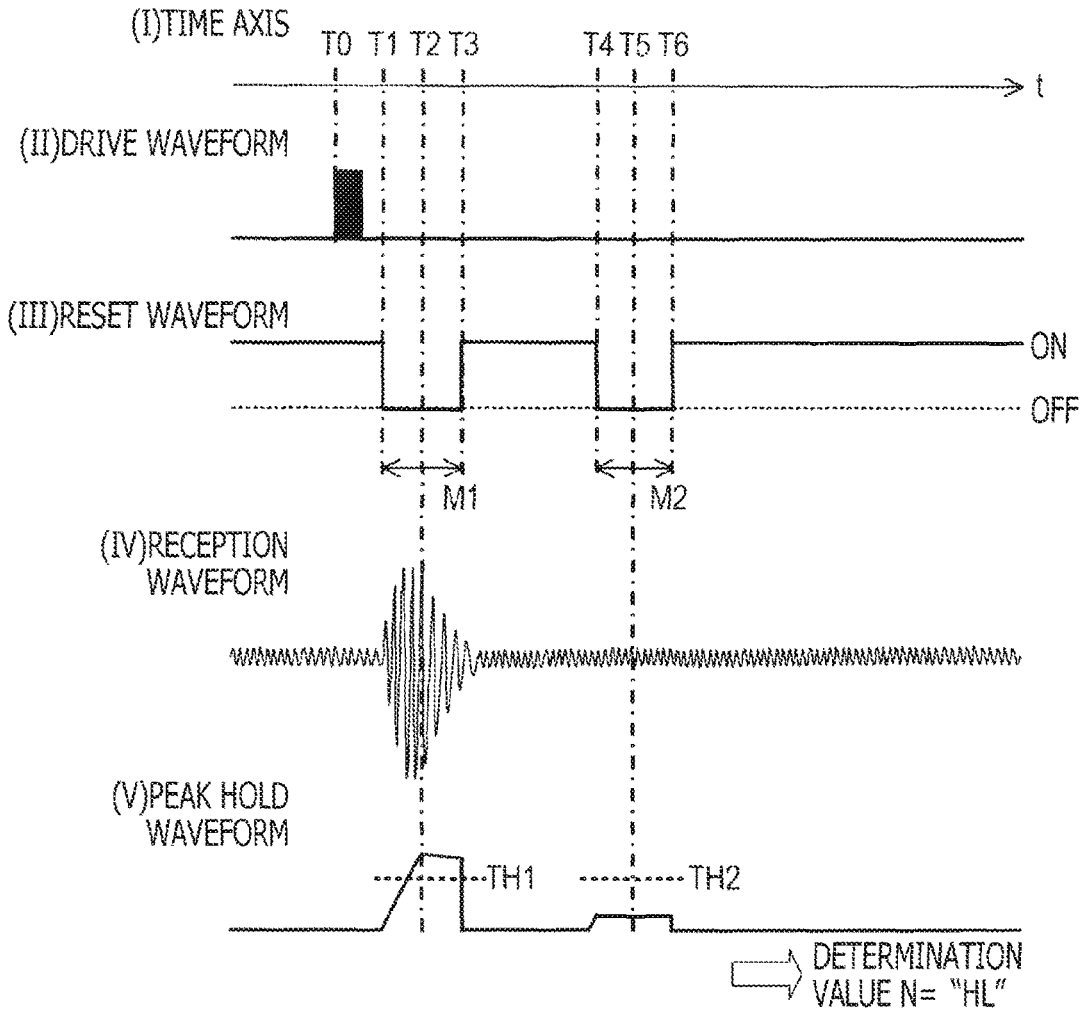

FIG. 5 exemplifies a drive waveform of a burst wave input into the emitter from the sensor driver, a reset waveform of a reset signal input into a peak hold circuit from the sensor driver, a reception waveform of a reception signal output via an amplifier circuit from the receiver in response to receipt of the ultrasonic wave emitted by the emitter, and a peak hold waveform of a peak hold value output from the peak hold circuit when a determination value N="HL," in the illustrative embodiment according to one or more aspects of the present disclosure.

Figure 6:
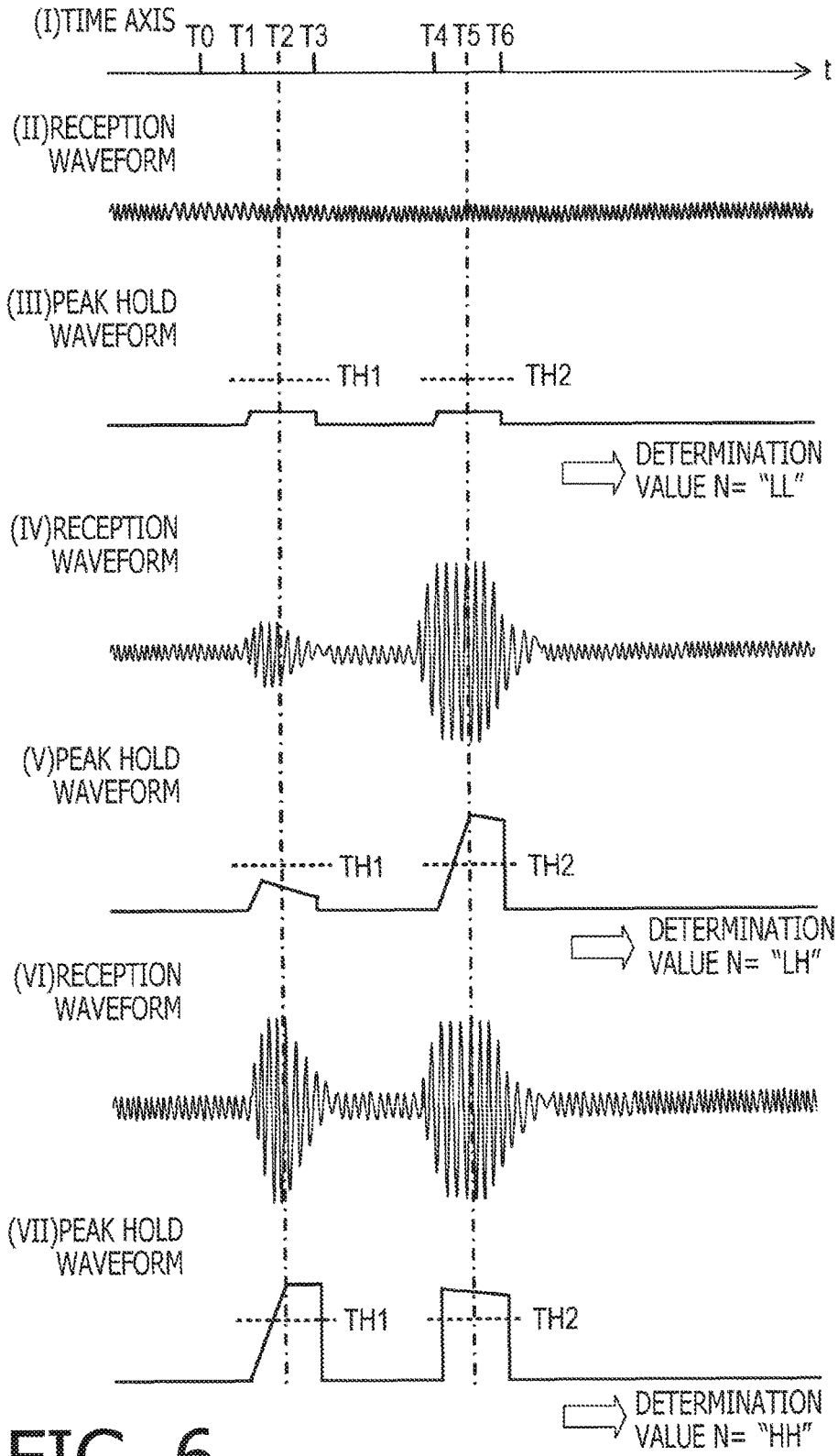

FIG. 6 exemplifies a reception waveform and a peak hold waveform when the determination value N="LL," a reception waveform and a peak hold waveform when the determination value N="LH," and a reception waveform and a peak hold waveform when the determination value N="HH," in the illustrative embodiment according to one or more aspects of the present disclosure.

Figure 7:
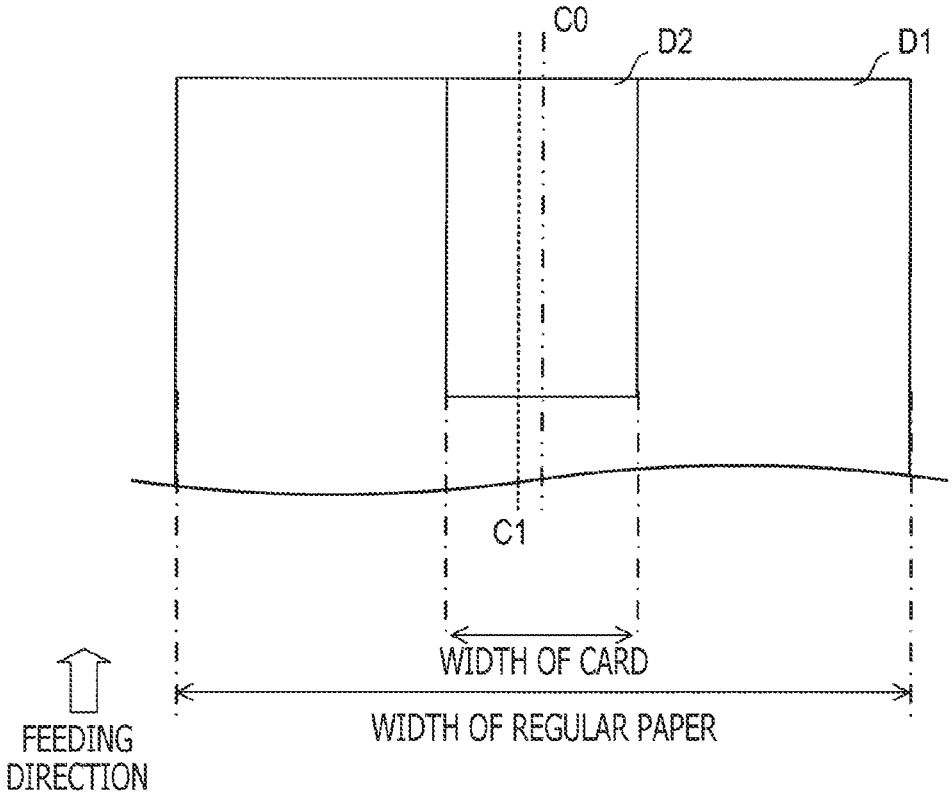

FIG. 7 shows a positional relationship between the ultrasonic sensor and document sheets in the illustrative embodiment according to one or more aspects of the present disclosure.

Figure 8:
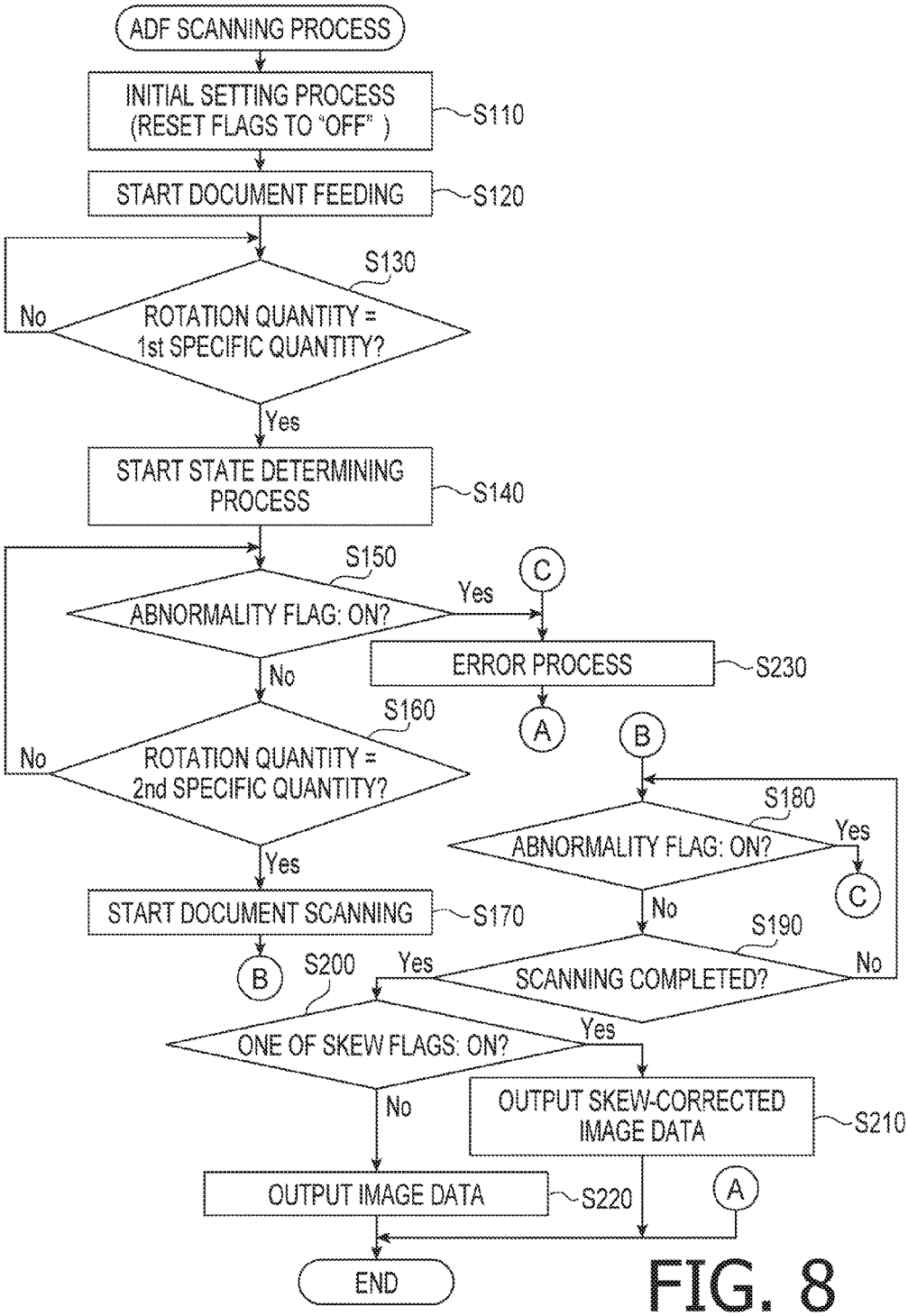

FIG. 8 is a flowchart showing a procedure of an ADF scanning process to be executed by the controller in the illustrative embodiment according to one or more aspects of the present disclosure.

Figure 9A:
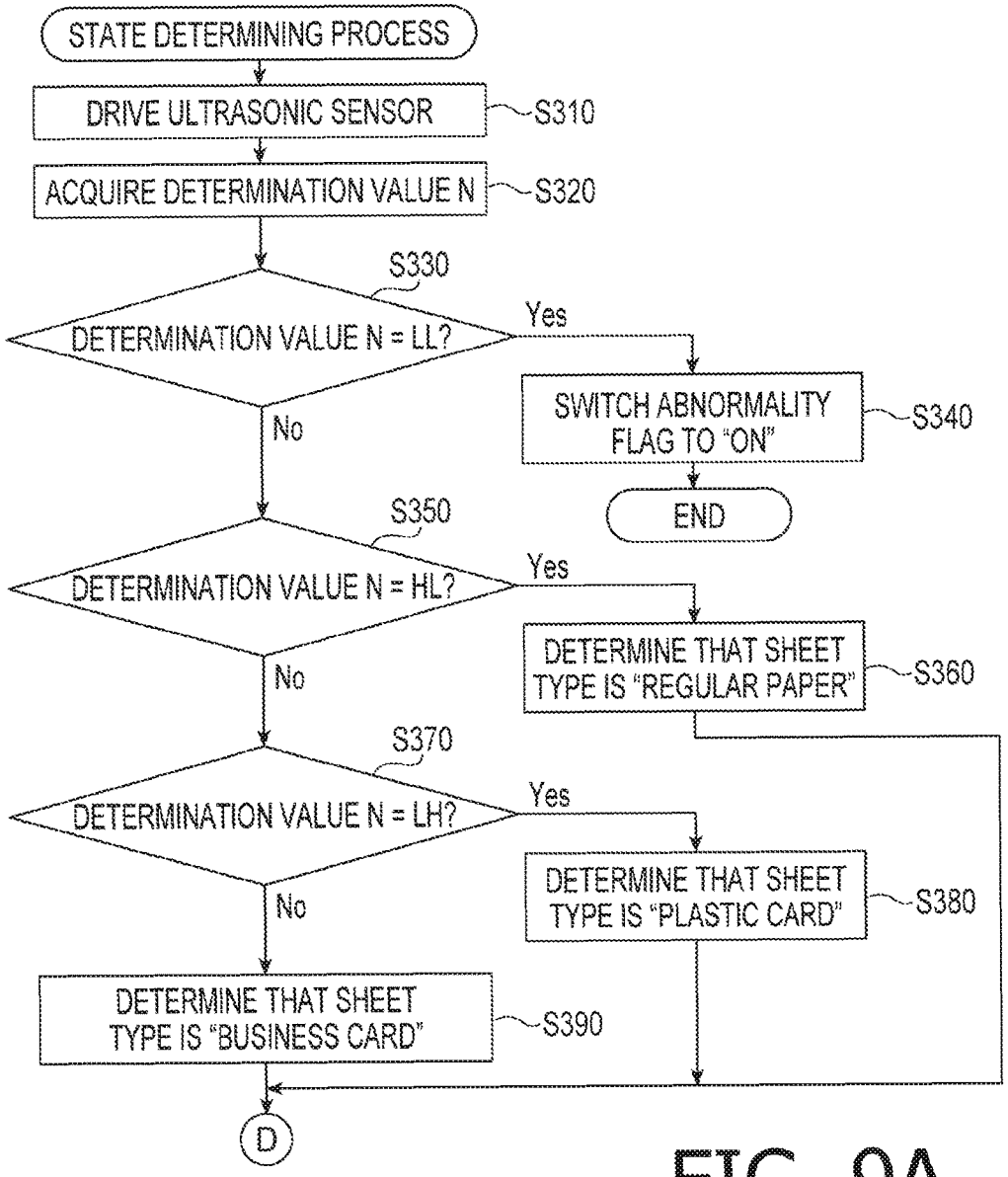
Figure 9B:
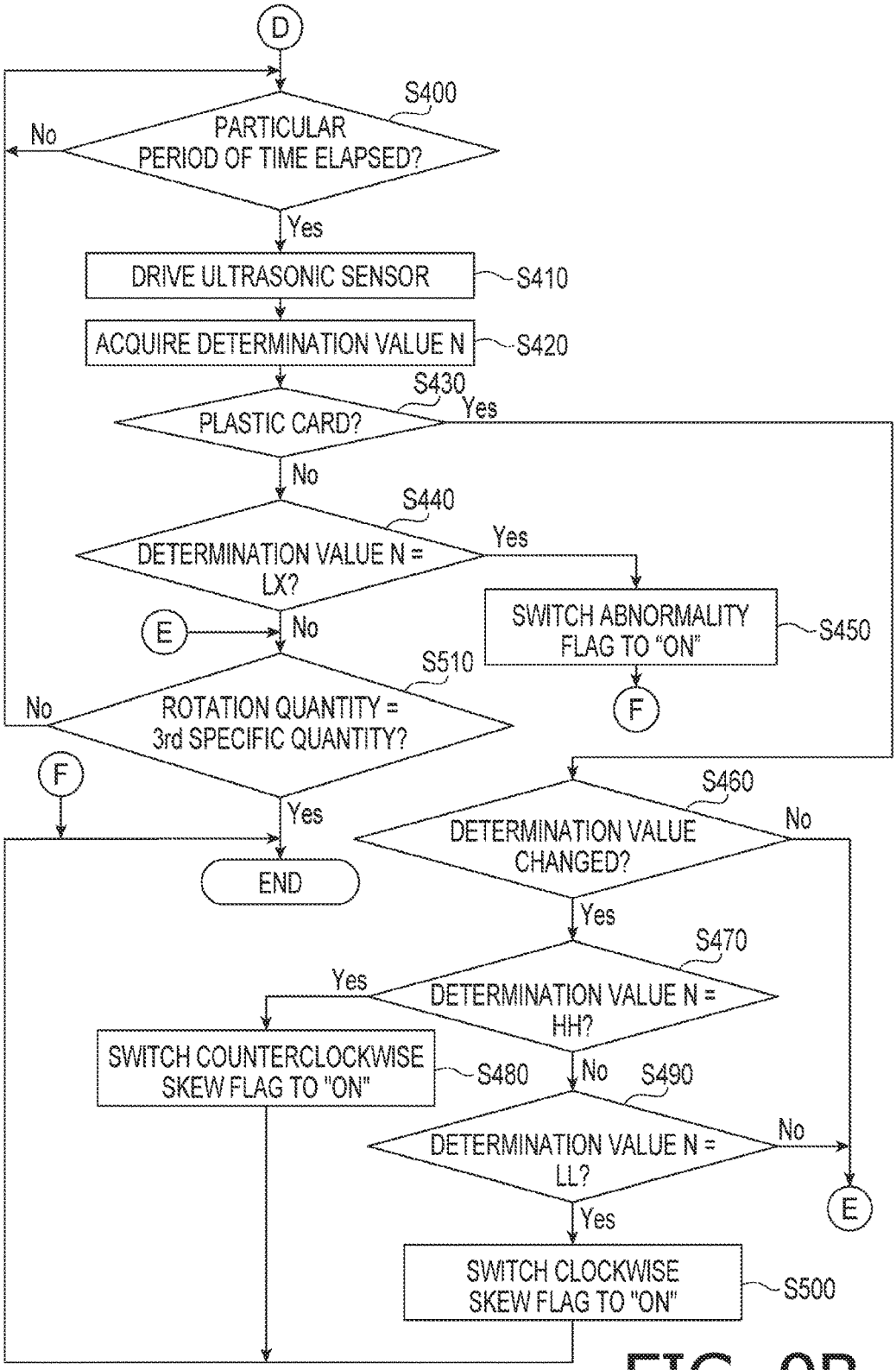

FIGS. 9A and 9B are flowcharts showing a procedure of a state determining process to be executed by the controller in the illustrative embodiment according to one or more aspects of the present disclosure.

Figure 10:
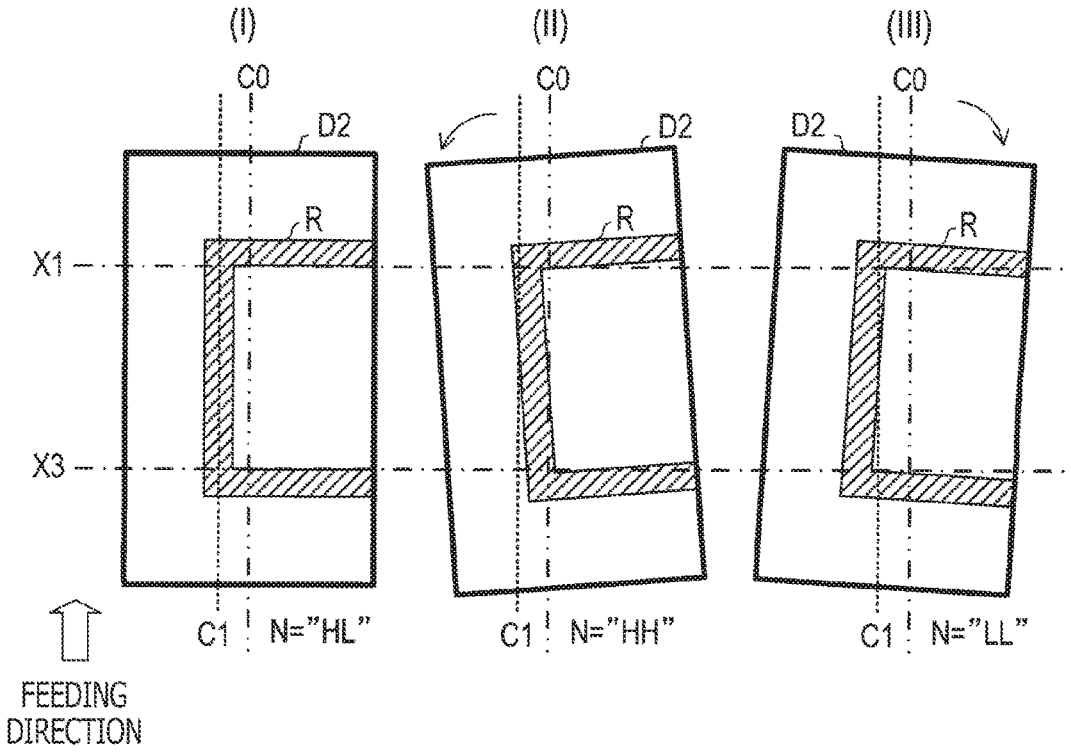

FIG. 10 shows a positional relationship between an un-skewed card and the ultrasonic sensor (area (I)), a positional relationship between a counterclockwise-skewed card and the ultrasonic sensor (area (II)), and a positional relationship between an un-skewed card and the ultrasonic sensor (area (III)) in the illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Figure 1:
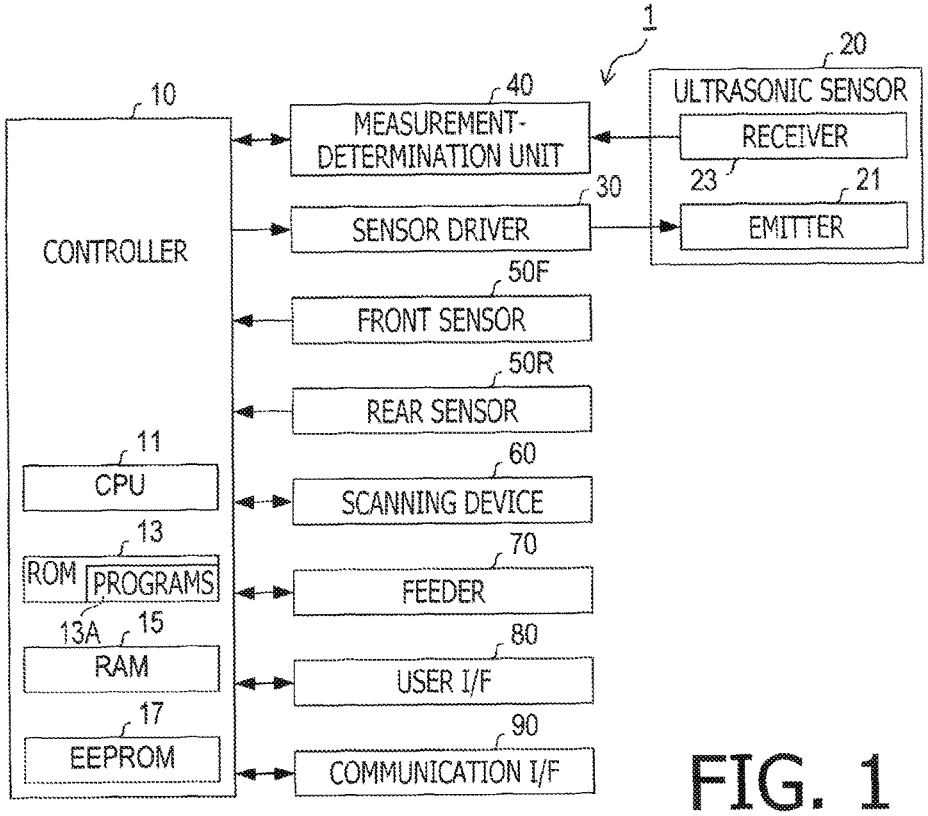
FIG. 1 is a block diagram schematically showing a configuration of an image scanner in an illustrative embodiment according to one or more aspects of the present disclosure.
Figure 2:
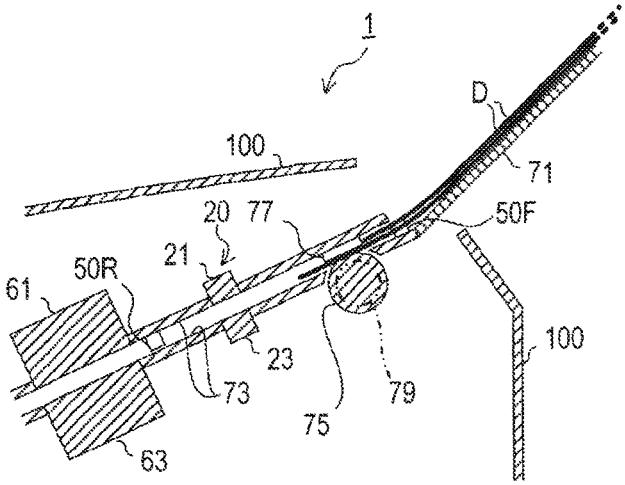
FIG. 2 is a cross-sectional view schematically showing a configuration around a feeding path for feeding document sheets therealong, in the illustrative embodiment according to one or more aspects of the present disclosure.

Hereinafter, an image scanner 1 of an illustrative embodiment according to aspects of the present disclosure will be described with reference to the accompanying drawings. As shown in FIG. 1, the image scanner 1 includes a controller 10, an ultrasonic sensor 20, a sensor driver 30, a measurement-determination unit 40, a front sensor 50F, a rear sensor 50R, a scanning device 60, a feeder 70, a user I/F 80, and a communication I/F 90. As shown in FIG. 2, the image scanner 1 is configured as an ADF-type image scanner. It is noted that "ADF" is an abbreviated form of "automatic document feeder."

The controller 10 includes a CPU 11, a ROM 13, a RAM 15, and an EEPROM 17. The CPU 11 is configured to take overall control of each of elements included in the image scanner 1 by performing processes according to programs 13A stored in the ROM 13. The RAM 15 is used as a work memory when the CPU 11 is performing processes. The EEPROM 17 is an electrically-rewritable non-volatile memory for storing various kinds of setting data. In the following descriptions, each process to be performed by the controller 10 may be implemented by the CPU 11 executing one or more programs 13A stored in the ROM 13.

The ultrasonic sensor 20 includes an emitter 21 and a receiver 23. As shown in FIG. 2, the ultrasonic sensor 20 is disposed along a feeding path 73 inside a housing 100 of the image scanner 1. The feeding path 73 is configured as a sheet guide along which document sheets D are fed. The ultrasonic sensor 20 is used to determine a feeding state of the document sheets D being fed along the feeding path 73 from a feed tray 71.

Figure 3A:
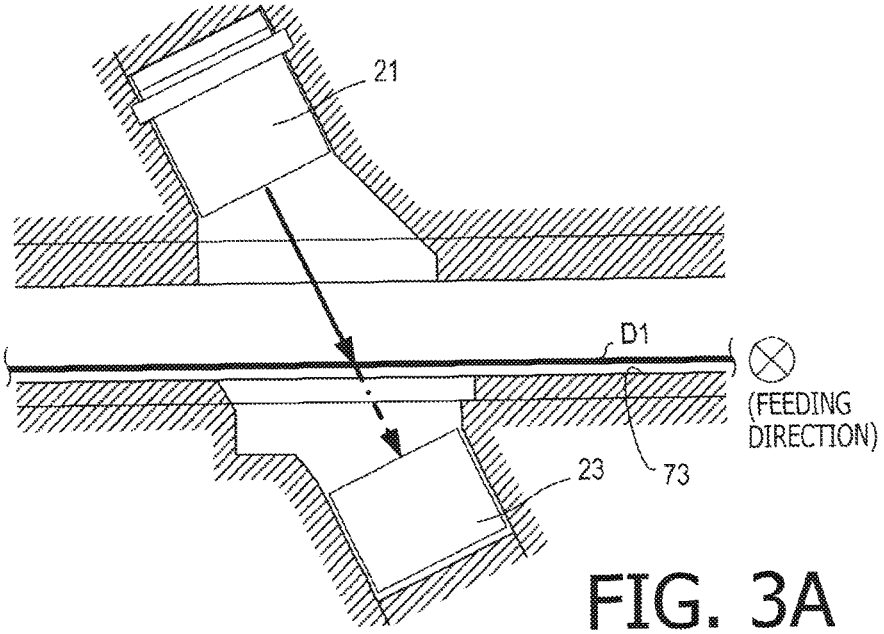
FIG. 3A shows how a direct wave of an ultrasonic wave emitted by an emitter of an ultrasonic sensor propagates to a receiver of the ultrasonic sensor, in the illustrative embodiment according to one or more aspects of the present disclosure.
Figure 3B:
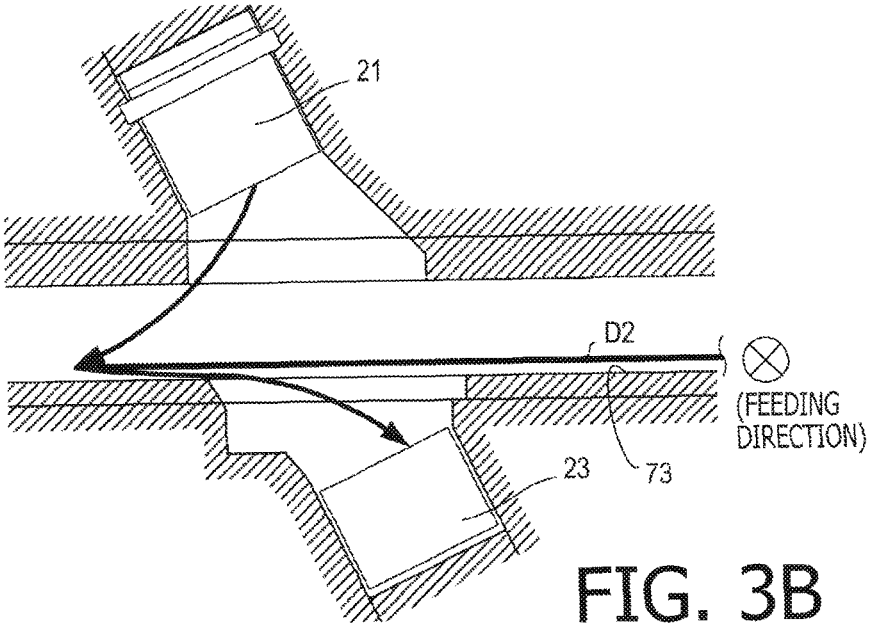
FIG. 3B shows how a diffracted wave of the ultrasonic wave emitted by the emitter of the ultrasonic sensor propagates to the receiver of the ultrasonic sensor, in the illustrative embodiment according to one or more aspects of the present disclosure.

The emitter 21 and the receiver 23 are opposed to each other across the feeding path 73. More specifically, the emitter 21 is disposed to face a first side (e.g., an upward-facing surface) of a document sheet D being fed along the feeding path 73. Specifically, as shown in FIGS. 3A and 3B, the emitter 21 is disposed in a state where an emitting surface thereof for emitting ultrasonic waves is exposed to the feeding path 73. It is to be noted that FIG. 2 schematically shows where and how the emitter 21 and the receiver 23 are disposed, for the sake of simple illustration. For example, the document sheets D to be fed along the feeding path 73 may include regular papers D1 and plastic cards D2.

The emitter 21 is configured to, when driven by the sensor driver 30, emit an ultrasonic wave toward the receiver 23. The sensor driver 30 is configured to, in response to receiving a drive instruction from the controller 10, cause the emitter 21 to emit an ultrasonic wave by inputting a burst wave (see area (II) of FIG. 5,) into the emitter 21. The emitter 21 outputs the ultrasonic wave after converting into the ultrasonic wave the burst wave as an electrical signal input by the sensor driver 30.

The receiver 23 is disposed to face a second side (e.g., a downward-facing surface) of the document sheet D being fed along the feeding path 73. Specifically, as shown in FIGS. 3A and 3B, the receiver 23 is opposed to the emitter 21 in a state where a receiving surface thereof for receiving ultrasonic waves is exposed to the feeding path 73.

As shown in FIGS. 3A and 3B, when viewed in a feeding direction in which the document sheet D is fed, the emitter 21 and the receiver 23 are disposed to be inclined with respect to the feeding path 73 extending in a width direction perpendicular to the feeding direction. In other words, a particular direction in which the emitter 21 and the receiver 23 are opposed to each other is inclined relative to the feeding path 73 extending in the width direction, in a cross-sectional view taken along a plane perpendicular to the feeding direction. Thereby, the emitter 21 emits an ultrasonic wave obliquely onto the first side of the document sheet D being fed along the feeding path 73. It is noted that in FIGS. 3A and 3B, the feeding direction is a normal direction with respect to a flat surface of the figures.

The receiver 23 is configured to, in response to receiving the ultrasonic wave from the emitter 21, transmit an electrical signal as a reception signal to the measurement-determination unit 40. The electrical signal indicates a voltage corresponding to a reception intensity of the ultrasonic wave received by the receiver 23.

The measurement-determination unit 40 is configured to determine the reception intensity of the received ultrasonic wave on the basis of two levels of high (H) and low (L), based on the reception signal received from the receiver 23. The determination result is transmitted as a determination value N to the controller 10. Although the following features will be described in detail later, the controller 10 determines a feeding state of the document sheet D in a detectable area between the emitter 21 and the receiver 23 within the feeding path 73, based on the determination value N received from the measurement-determination unit 40. Specifically, the controller 10 determines which state of first to fifth states, the feeding state of the document sheet D is.

The first state is a feeding state in which a regular paper D1 as the document sheet D is fed alone and independently without overlapping any other paper. Namely, the first state is not a multi-feed state. The second state is a state in which a regular paper D1 as the document sheet D is fed in a multi-feed manner overlapping one or more other papers. The third state is a feeding state in which a plastic card D2 as the document sheet D is fed. The plastic card D2 is smaller in size than the regular paper D1. An example of the plastic card D2 may be a membership card, a license card, and a credit card. In general, since the plastic card D2 is thick, the plastic card D2 is not fed in a multi-feed manner overlapping one or more other cards. The plastic card D2 is more likely to be fed in a skewed state. Therefore, when the plastic card D2 is fed, it is further determined whether the plastic card D2 is skewed and in which direction the skewed plastic card D2 is slanted.

The fourth state is a feeding state in which a small-sized thick paper (e.g., a business card) as the document sheet D is fed alone and independently without overlapping any other card. Namely, the fourth state is not a multi-feed state. The fifth state is a feeding state in which a business card is fed in a multi-feed manner overlapping one or more other cards.

As shown in FIG. 2, the front sensor 50F is disposed in a joint portion between the feed tray 71 and the feeding path 73. The front sensor 50F is configured to detect a document sheet D placed on the feed tray 71. Further, when detecting a document sheet D, the front sensor 50F transmits to the controller 10 an ON signal as a detection signal.

As shown in FIG. 2, the rear sensor 50E is disposed downstream of the ultrasonic sensor 20 and upstream of a document scanning position where line sensors 61 and 63 perform image scanning, in the feeding direction. The rear sensor 50R is configured to detect passage of a document sheet D supplied to the document scanning position. When detecting a document sheet D, the rear sensor 50R transmits to the controller 10 an ON signal as a detection signal.

The scanning device 60 is configured to scan a document sheet D passing the document scanning position, in accordance with an instruction from the controller 10, and transmit to the controller 10 scanned image data that represents scanned images of both sides of the document sheet D. The scanning device 60 is disposed downstream of the rear sensor 50R in the feeding direction. The scanning device 60 includes the line sensors 61 and 63. The document scanning position corresponds to a position where the line sensors 61 and 63 are disposed on the feeding path.

For instance, each of the line sensors 61 and 63 may be configured as a contact image sensor. The scanning device 60 optically scans the first side of the document sheet D with the line sensor 61, and optically scans the second side of the document sheet D with the line sensor 63. The scanning device 60 transmits the scanned image data of the both sides of the document sheet D to the controller 10.

The feeder 70 is configured to operate in accordance with instructions from the controller 10, separate a single document D from a stack of document sheets D placed on the feed tray 71, and feed the separated document D downstream in the feeding direction. As shown in FIG. 2, the feeder 70 includes the feed tray 71 and the feeding path 73 extending substantially from the feed tray 71.

The feeder 70 further includes a separation roller 75, a separation pad 77, and a motor (not shown). By driving the separation roller 75 to rotate via the motor in accordance with an instruction from the controller 10, the feeder 70 separates a single document D from a stack of document sheets D placed on the feed tray 71, and feeds the separated document D downstream in the feeding direction. On the feed tray 71, the document sheets D are stacked in such a manner that center lines C0 thereof are positioned to be coincident with a position specified on the feed tray 71, regardless of the size of the document sheets D. For instance, the specified position may be defined as a center of the feed tray 71 in the width direction perpendicular to the feeding direction. In this case, the center of the feed tray 71 in the width direction may correspond to a feeding center, of the feeding path 73, on and along which the document sheets D are fed.

The separation pad 77 is disposed to face the separation roller 75. Thereby, a single document D of the document sheets D stacked on the feed tray 71 is selectively fed downstream in the feeding direction by rotation of the separation roller 75. In this respect, however, two or more document sheets D might be fed from the feed tray 71 in a mutually-overlapping manner with low probability. This is an abnormal feeding state referred to as "multi-feed."

The feeder 70 further includes a rotary encoder 79. The rotary encoder 79 is attached to a rotation shaft of the separation roller 75. The rotary encoder 79 outputs encoder signals according to the rotation of the separation roller 75. The feeder 70 measures a rotation quantity of the separation roller 75 based on the encoder signal. The feeder 70 transmits the measured rotation quantity to the controller 10.

The user I/F 80 includes a display, a speaker, and a user-operable operation unit (e.g., a touch panel). The display is configured to display thereon various kinds of information. The speaker is configured to output sounds. The communication I/F 90 is configured to communicate with external devices. When controlled by the controller 10, the communication I/F 90 transmits the scanned image data of the document sheet D, e.g., to an external device.

Figure 4:
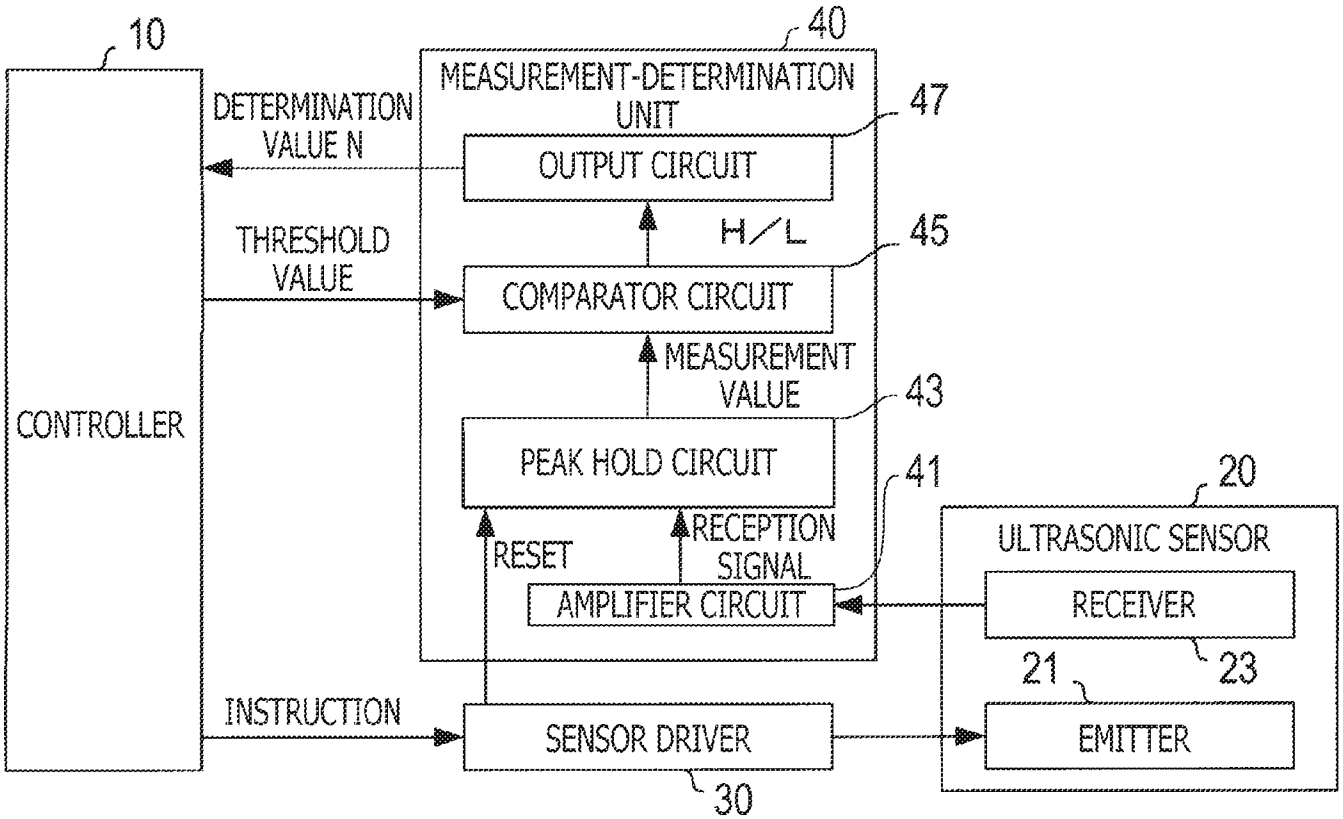
FIG. 4 is a block diagram showing a configuration of a measurement-determination unit connected with a controller, a sensor driver, and the ultrasonic sensor in the illustrative embodiment according to one or more aspects of the present disclosure.

Subsequently, the measurement-determination unit 40 will be described. As shown in FIG. 4, the measurement-determination unit 40 includes an amplifier circuit 41, a peak hold circuit 43, a comparator circuit 45, and an output circuit 47. The amplifier circuit 41 is configured to amplify the reception signal transmitted thereto by the receiver 23 in response to receipt of the ultrasonic wave. The amplified reception signal is transmitted to the peak hold circuit 43.

The peak hold circuit 43 is configured to hold a peak voltage of an input signal, as well as a known peak hold circuit. Hereinafter, a peak voltage held by the peak hold circuit 43 may be referred to as a "peak hold value."

Specifically, when a reset signal received from the sensor driver 30 is ON, the peak hold circuit does not hold a peak voltage. Accordingly, when the reset signal is ON, the peak hold value indicated by the peak hold circuit 43 is zero.

Meanwhile, when the reset signal received from the sensor driver 30 is OFF, the peak hold circuit holds a peak voltage. Accordingly, with respect to the amplified reception signal received from the amplifier circuit 41, from a point of time when the reset signal is changed from ON to OFF, the peak hold circuit 43 begins to hold a peak voltage of the amplified reception signal. The peak hold value, which represents the peak voltage of the amplified reception signal, corresponds to a measurement value of the reception intensity of the ultrasonic wave received by the receiver 23.

The comparator circuit 45 determines the reception intensity of the received ultrasonic wave on the basis of two levels of high (H) and low (L), by comparing the peak hold value indicated by the peak hold circuit 43 with a threshold value set by the controller 10. Specifically, when the peak hold value is higher than the threshold value, the comparator 45 determines that the reception intensity is high (H). Meanwhile, when the peak hold value is equal to or lower than the threshold value, the comparator 45 determines that the reception intensity is low (L).

In the illustrative embodiment, as shown in FIG. 5, after an ultrasonic wave is emitted by the emitter 21, the reset signal input into the peak hold circuit 43 is changed to OFF during each of a first measurement period M1 and a second measurement period M2. Accordingly, in the illustrative embodiment, after an ultrasonic wave is emitted by the emitter 21, the peak hold circuit 43 holds the peak voltage during each of the first measurement period M1 and the second measurement period M2.

In FIG. 5, the area (II) shows a drive waveform, which is an input waveform of the burst wave input into the emitter 21 from the sensor driver 30, in a graph with a horizontal axis as a time axis. It is noted that the time axis is shown in an area (I) of FIG. 5. A time T0 corresponds to a point of time when the burst wave begins to be input into the emitter 21. Further, the time T0 corresponds to a time at which the ultrasonic wave begins to be emitted by the emitter 21.

A time T1 corresponds to a point of time when the first measurement period M1 starts. A time T3 corresponds to a point of time when the first measurement period M1 ends. A time T2 corresponds to a central time of the first measurement period M1. A time T4 corresponds to a point of time when the second measurement period M2 starts. A time T6 corresponds to a point of time when the second measurement period M2 ends. A time T5 corresponds to a central time of the second measurement period M2. The first measurement period M1 and the second measurement period M2 have a particular time length. An area (III) of FIG. 5 shows the ON/OFF states of the reset signal input into the peak hold circuit 43 from the sensor driver 30, as a reset waveform in a graph having the same time axis as the drive waveform.

In the first measurement period M1, a first measurement of the reception intensity is made, and a peak hold value representing the reception intensity of the ultrasonic wave received by the receiver 23 during the first measurement period M1 is transmitted to the comparator circuit 45. In the second measurement period M2 after the first measurement period M1, a second measurement of the reception intensity is made, and a peak hold value representing the reception intensity of the ultrasonic wave received by the receiver 23 during the second measurement period M2 is transmitted to the comparator circuit 45.

After comparing the peak hold value with the threshold value in each of the first measurement period M1 and the second measurement period M2, the comparator circuit 45 transmits to the output circuit 47 the binarized reception intensity (i.e., high (H) or low (L)) of the ultrasonic wave received during each of the first measurement period M1 and the second measurement period M2. The threshold value for the first measurement period M1 is a threshold value TH1. The threshold value for the second measurement period M2 is a threshold value TH2.

Namely, by comparing the peak hold value, which represents the reception intensity of the ultrasonic wave received during the first measurement period M1, with the threshold value TH1, the comparator circuit 45 determines a value N1 for the reception intensity of the ultrasonic wave received during the first measurement period M1 on the basis of two levels of high (H) and low (L). Then, the comparator circuit 45 transmits the determined value N1 to the output circuit 47. Additionally, by comparing the peak hold value, which represents the reception intensity of the ultrasonic wave received during the second measurement period M2, with the threshold value TH2, the comparator circuit 45 determines a value N2 for the reception intensity of the ultrasonic wave received during the second measurement period M2 on the basis of two levels of high (H) and low (L). Then, the comparator circuit 45 transmits the determined value N2 to the output circuit 47.

The output circuit 47 transmits to the controller 10 a determined value N=(N1, N2) as a combination of the determined value N1 for the reception intensity of the ultrasonic wave received during the first measurement period M1 and the determined value N2 for the reception intensity of the ultrasonic wave received during the second measurement period M2. The determined value N input into the controller 10 is one of "HL," "LL," "LH," and "HH."

An area (IV) of FIG. 5 shows a reception waveform corresponding to a reception signal output from the receiver 23 when the determined value N="HL," in a graph with a horizontal axis as the time axis. More specifically, the reception waveform shown in the area (IV) corresponds to a waveform of a reception signal output (via the amplifier circuit 41) from the receiver 23 in response to receipt of ultrasonic wave emitted by the emitter 21 in accordance with the drive waveform shown in the area (II). Further, an area (V) of FIG. 5 shows a waveform of a peak hold value output from the peak hold circuit 43 when the reception signal corresponding to the reception waveform shown in the area (IV) is input into the peak hold circuit 43, in a graph with a horizontal axis as the time axis. The determined value N="HL" is obtained when regular papers D1 are fed normally without overlapping each other (i.e., the feeding state in this case is the aforementioned first state).

In FIG. 6, an area (I) shows the same time axis as shown in FIG. 5. An area (II) of FIG. 6 shows a reception waveform corresponding to a reception signal output from the receiver 23 when the determined value N="LL," in a graph with a horizontal axis as the time axis. An area (III) of FIG. 6 shows a waveform of a peak hold value output from the peak hold circuit 43 when the reception signal corresponding to the reception waveform shown in the area (II) is input into the peak hold circuit 43, in a graph with a horizontal axis as the time axis. The determined value N="LL" is obtained when regular papers D1 are fed in a mutually-overlapping manner (i.e., when the feeding state is the second state).

An area (IV) of FIG. 6 shows a reception waveform corresponding to a reception signal output from the receiver 23 when the determined value N="LH," in a graph with a horizontal axis as the time axis. An area (V) of FIG. 6 shows a waveform of a peak hold value output from the peak hold circuit 43 when the reception signal corresponding to the reception waveform shown in the area (IV) is input into the peak hold circuit 43, in a graph with a horizontal axis as the time axis. The determined value N="LH" is obtained when plastic cards D2 are fed (i.e., when the feeding state is the third state).

An area (VI) of FIG. 6 shows a reception waveform corresponding to a reception signal output from the receiver 23 when the determined value N="HH," in a graph with a horizontal axis as the time axis. An area (VII) of FIG. 6 shows a waveform of a peak hold value output from the peak hold circuit 43 when the reception signal corresponding to the reception waveform shown in the area (VII) is input into the peak hold circuit 43, in a graph with a horizontal axis as the time axis. The determined value N="HH" is obtained when business cards are fed normally without overlapping each other (i.e., when the feeding state is the fourth state).

According to the illustrative embodiment, the first measurement period M1 is defined as a period of time for measuring a reception intensity of a direct wave. The direct wave is a component of the ultrasonic wave that propagates from the emitter 21 to the receiver 23 through a path on and along an axis line extending from the emitter 21 to the receiver 23 as indicated by arrows in FIG. 3A. The period M1 may be determined based on a relationship between a propagation velocity of the ultrasonic wave and a distance between the emitter 21 and the receiver 23. In FIG. 3A, an alternate short and long dash arrow represents that the ultrasonic wave shown by a solid arrow reaches the receiver 23 after being transmitted through a document sheet D (e.g., a regular paper D1) while attenuating.

The second measuring period M2 is defined as a period of time for measuring a reception intensity of a diffracted wave. As indicated by arrows in FIG. 3B, the diffracted wave is generated when a document sheet D (e.g., a business card and a plastic card D2) smaller in size than the regular paper D1 is conveyed. The diffracted wave is a component of the ultrasonic wave that propagates from the emitter 21 to the receiver 23 in a manner detouring around the document sheet D.

In the illustrative embodiment, the receiver 23 is disposed fixedly in a specific position that is a particular distance away from the center line C0 of the document sheet D extending along the feeding direction, in the width direction perpendicular to the feeding direction. In FIG. 7, an alternate long and two short dashes line corresponds to the feeding center, of the feeding path 73, on and along which the document sheet D is fed, and indicates the center line C0 of the document sheet D which is normally being fed. Further, in FIG. 7, a dotted line indicates a trajectory C1 of the receiver 23 moving relative to the document sheet D when the document sheet D passes over the receiver 23. The emitter 21 is positioned close to the dotted line. As described above, the receiver 23 is disposed fixedly in the specific position. Nonetheless, as the document sheet D is conveyed, a relative position of the receiver 23 with respect to the document sheet D moves on and along the dotted line.

According to the illustrative embodiment, as described above, the center line C0 of the document sheet D is positioned to be coincident with the specified position on the feed tray 71. Therefore, when the document sheet D is fed normally without being skewed, the center line C0 of the document sheet D passes through a particular position on the feeding path 73, regardless of the size of the document sheet D. As understood from FIG. 7, in feeding of an A4-size paper as a typical example of the regular paper D1, a side edge of the A4-size paper along the feeding direction moves along a line very far from the receiver 23. Accordingly, when the document sheet D is the regular paper D1, the receiver 23 hardly receives any diffracted wave. If the receiver 23 received a diffracted wave, the receiver 23 would receive the diffracted wave with a long delay after receiving a direct wave.

Meanwhile, in feeding of a business card or a plastic card D2, a side edge thereof along the feeding direction moves along a line relatively close to the receiver 23. Accordingly, when the document sheet D is the business card or the plastic card D2, the receiver 23 receives a diffracted wave that reaches the receiver 23 after passing by the side edge of the document sheet D along the feeding direction, as indicated by the arrows in FIG. 3B.

Thus, in the illustrative embodiment, the size of the document sheet D is determined based on whether the receiver 23 has received such a diffracted wave. In order to make it possible to determine the size of the document sheet D, the second measurement period M2 is determined based on a distance between the emitter 21 and the side edge of the small-sized thick document D such as the business card and the plastic card D2, a distance between the side edge and the receiver 23, and the propagation velocity of the ultrasonic wave. Specifically, the second measurement period M2 is determined as a period of time within which it is possible to receive a diffracted wave caused when the small-sized thick document D such as the business card and the plastic card D2 is being fed, without receiving a direct wave. For instance, the size of the small-sized thick document D such as the business card and the plastic card D2 may be 91 mm×55 mm. The first measurement period M1 and the second measurement period M2 may not necessarily be determined merely by theoretical calculation on the desk, but may be adjusted through experiments in such a manner that it is possible to selectively receive a direct wave within the first measurement period M1 and receive a diffracted wave within the second measurement period M2.

Thus, as the first determination period M1 and the second determination period M2 are determined in the aforementioned manner, when the determination value N="XH" ("X" may be "H" or "L"), it is determined that the document sheet D being fed is not a regular paper D1 but is a business card or a plastic card D2. Further, a paper business card attenuates the direct wave transmitted therethrough at a lower attenuation degree than the plastic card D2. Therefore, when such a paper business card is conveyed, a reception intensity of the ultrasonic wave received by the receiver 23 during the first measurement period M1 is higher than when the plastic card D2 is conveyed. In other words, when the plastic card D2, which attenuates the direct wave transmitted therethrough at a higher attenuation degree, is conveyed, a reception intensity of the ultrasonic wave received by the receiver 23 during the first measurement period M1 is lower than when the paper business card is conveyed. Hence, when the determination value N="LH," it is determined that the document sheet D being fed is a plastic card D2. Meanwhile, when the determination value N="HH," it is determined that the document sheet D being fed is a business card.

Further, when the determination value N="XL," it is determined that the document sheet D being fed is a regular paper D1. In addition, when multi-feed is occurring, a reception intensity of the ultrasonic wave received by the receiver 23 during the first measurement period M1 is lower than when multi-feed is not occurring. Therefore, when the determination value N="HL," it is determined that one or more regular papers D1 are normally conveyed. Meanwhile, when the determination value N="LL," it is determined that two or more regular papers D1 are fed in a multi-feed manner. An appropriate value as the threshold value TH2 is usually equal to or more than the threshold value TH1. Nonetheless, the threshold value TH2 may be set to be equal to the threshold value TH1.

Subsequently, an ADF scanning process will be described with reference to FIGS. 8 to 10. The ADF scanning process is performed by the controller 10 (e.g., by the CPU 11 executing one or more programs 13A stored in the ROM 13) in response to a scanning instruction being input by a user via the user I/F 80 or from an external device via the communication I/F 90. The controller 10 repeatedly performs the ADF scanning process until the document sheets D placed on the feed tray 71 have been all fed.

After starting the ADF scanning process, the controller 10 first performs an initial setting process (S110). The initial setting process includes a below-mentioned procedure to reset various flags to "OFF." Subsequently, the controller 10 inputs, into the feeder 70, an instruction to start an operation of separating a single document sheet D from the document sheets D placed on the feed tray 71 and feeding the separated document sheet D downstream in the feeding direction (S120). Afterwards, the controller 10 determines whether the rotation quantity of the separation roller 75 has become a first specific quantity (S130). Thereby, it is determined whether the document sheet D has reached the detectable area between the emitter 21 and the receiver 23. The first specific quantity is determined as a rotation quantity of the separation roller 75 for the document sheet D to reach the detectable area. Hereinafter, the rotation quantity of the separation roller 75 may be referred to as a "roller rotation quantity."

In response to determining that the roller rotation quantity has become the first specific quantity (S130), the controller 10 starts a state determining process shown in FIGS. 9A and 9B (S140). The state determining process is performed in parallel with the ADF scanning process. After starting the state determining process, the controller 10 inputs a drive instruction into the sensor driver 30, thereby controlling the sensor driver 30 to drive the ultrasonic sensor 20 (S310). In response to receipt of the drive instruction, the sensor driver 30 inputs the burst wave shown in the area (II) of FIG. 5 into the emitter 21, thereby driving the emitter 21 to emit an ultrasonic wave. Further, the sensor driver 30 inputs a reset signal into the peak hold circuit 43 to switch the reset signal to "OFF" during each of the first measurement M1 and the second measurement period M2. It is noted that the first measurement M1 and the second measurement period M2 are determined on the basis of a point of time (i.e., the time T0) when the burst wave begins to be input into the emitter 21.

In synchronization with the reset signal, the measurement-determination unit 40 compares the peak hold value in the first measurement period M1 with the threshold value TH1 and compares the peak hold value in the second measurement period M2 with the threshold value TH2. Then, the measurement-determination unit 40 transmits the determination values N=(N1, N2) obtained by the comparisons, to the controller 10.

After transmitting the drive instruction to the sensor driver 30 (S310), the controller 10 receives the determination value N from the measurement-determination unit 40 (S320). Further, the controller 10 determines whether the received determination value N is equal to "LL" (S330). In response to determining that the received determination value N is equal to "LL" (S330: Yes), the controller 10 determines that the feeding state is the second state where regular papers D1 are fed in a multi-feed manner, and sets an abnormality flag to "ON" (S340). The abnormality flag set to "ON" represents that multi-feed is occurring. Afterwards, the controller 10 terminates the state determining process.

In response to determining that the received determination value N is not equal to "LL" (S330: No), the controller 10 determines whether the determination value N is equal to "HL" (S350). In response to determining that the determination value N is equal to "HL" (S350: Yes), the controller 10 determines that the feeding state is the first state and that a sheet type of the document sheet D being fed is "regular paper" (S360). Afterwards, the controller 10 goes to S400 (see FIG. 9B).

In response to determining that the determination value N is not equal to "HL" (S350: No), the controller 10 goes to S370. There, the controller 10 determines whether the determination value N is equal to "LH" (S370). In response to determining that the determination value N is equal to "LH" (S370: Yes), the controller 10 determines that the sheet type of the document sheet D being fed is "plastic card" (S380). Thereafter, the controller 10 goes to S400. Meanwhile, in response to determining that the determination value N is not equal to "LH" but is equal to "HH" (S370: No), the controller 10 determines that the sheet type of the document sheet D being fed is "business card" (S390). Thereafter, the controller 10 goes to S400.

In S400, the controller 10 waits until a particular period of time has elapsed. The waiting operation in S400 is performed again to determine the feeding state of the document sheet D at a point of time when feeding of the document sheet D progresses. The controller usually performs document scanning while feeding the document sheet D at a constant speed. Accordingly, the lapse of the particular period of time corresponds to the document sheet D being conveyed over a particular distance. Thus, the operation in S400 may be replaced with an operation of waiting until the document sheet D has been conveyed over the particular distance.

After waiting until the particular period of time has elapsed (S400: Yes), the controller 10 again drives the ultrasonic sensor 20 (S410) and receives the determination value N from the measurement-determination unit 40 (S420). The determination value N acquired here is a determination value N=(N1, N2) corresponding to reception intensities of the ultrasonic waves received by the receiver 23 during the first measurement period M1 and the second measurement period M2 that are defined on the basis of a point of time when the emitter 21 begins to emit the ultrasonic wave in S410. The threshold values TH1 and TH2 for acquiring the determination value N in S420 may be equal to or different from the threshold values TH1 and TH2 used in S320.

After acquiring the determination value N in S420, based on the acquired determination value N, the controller 10 determines whether a plastic card D2 is fed in a skewed state, whether business cards are fed in a multi-feed state, and whether regular papers D1 are fed in a multi-feed state. Specifically, the controller 10 determines whether the sheet type of the document sheet D being fed is determined to be "plastic card," by the processes executed in S310 to S390 (S430). Then, when the sheet type of the document sheet D being fed is not determined to be "plastic card" but is determined to be a "regular paper" or a "business card" (S430: No), the controller 10 determines whether the determination value N acquired in S420 is equal to "LX" (S440). In other words, the controller 10 determines whether the determination value N acquired in S420 is equal to one of "LH" and "LL" (S440).

In response to determining that the determination value N acquired in S420 is not equal to "LX" (S440: No), the controller 10 determines that document feeding is normally performed, and goes to S510. Meanwhile, in response to determining that the determination value N acquired in S420 is equal to "LX" (S440: Yes), the controller 10 determines that multi-feed is occurring, and sets the abnormality flag to "ON" (S450). Thereafter, the controller 10 terminates the state determining process.

Even though multi-feed is not detected in the detectable area at the point of time when the emitter 21 emits the ultrasonic wave in S310, multi-feed may be actually occurring in a position upstream of the detectable area in the feeding direction, and a mutually-overlapping state of document sheets D may appear in the detectable area as the document sheets D are further conveyed. The determination value N acquired in S420 in response to the ultrasonic wave being emitted in S410 is useful to detect such multi-feed.

In particular, since the business card is thicker than the regular paper D1, even when multi-feed of business cards is occurring, in most cases, a leading end portion of a preceding business card is not overlapped with a subsequent business card. Accordingly, in general, the determination value N="HH" is acquired in response to the first emission of the ultrasonic wave in S310. When multi-feed of business cards is occurring, a mutually-overlapping state of the business cards appears in the detectable area as the business cards are further conveyed. In this case, since the mutually-overlapping business cards attenuate the direct wave at a high attenuation degree, the determination value N="LH" is acquired. Thus, in the illustrative embodiment, it is possible to detect multi-feed of business cards. Namely, when the determination value N is equal to "LL," it is possible to determine that multi-feed of regular papers D1 is occurring. Further, when the determination value N is equal to "LH," it is possible to determine that multi-feed of business cards is occurring.

When the sheet type of the document sheet D being fed is determined to be "plastic card" (S430: Yes), the controller 10 determines whether the determination value N has changed from the value "LH" (S460). In response to determining that the determination value N has not changed from the value "LH" (S460: No), the controller 10 determines that document feeding is normally performed, and goes to S510.

Meanwhile, in response to determining that the determination value N has changed from the value "LH" (S460: Yes), the controller 10 determines whether a value (i.e., the changed determination value N) to which the determination value N has changed from the value "LH" is "HH" (S470). In response to determining that the changed determination value N is "HH" (S470: Yes), the controller 10 switches a counterclockwise skew flag from "OFF" to "ON" (S480). Thereafter, the controller 10 terminates the state determining process.

Meanwhile, in response to determining that the changed determination value N is not "HH" (S470: No), the controller 10 determines whether the changed determination value N is "LL" (S490). In response to determining that the changed determination value N is "LL" (S490: Yes), the controller 10 switches a clockwise skew flag from "OFF" to "ON" (S500). Thereafter, the controller 10 terminates the state determining process.

When the changed determination value N is not "HH" or "LL" (S490: No), the controller 10 goes to S510. In S510, the controller 10 determines whether the roller rotation quantity has become a third specific quantity. In response to determining that the roller rotation quantity has not become the third specific quantity (S510: No), the controller 10 goes back to S400 and again executes the subsequent steps. In response to determining that the roller rotation quantity has become the third specific quantity (S510: Yes), the controller 10 terminates the state determining process.

Thus, the controller 10 controls the emitter 21 to emit an ultrasonic wave and determines whether abnormal document feeding such as "multi-feed" and "skewing" is occurring based on the determination value N acquired in response to the emission of the ultrasonic wave, every particular period of time until the roller rotation quantity becomes the third specific quantity or until the controller 10 switches to "ON" one of the abnormality flag, the counterclockwise skew flag, and the clockwise skew flag. The third specific quantity is defined as a roller rotation quantity for a plastic card D2 to be conveyed to a limit position up to which it is possible to properly detect "skewing."

In FIG. 10, an area (I) shows an un-skewed plastic card D2 as well as the center line C0 and the trajectory C1 of the receiver 23. An area (II) of FIG. 10 shows a counterclockwise-skewed plastic card D2 as well as the center line C0 and the trajectory C1 of the receiver 23. An area (III) of FIG. 10 shows a clockwise-skewed plastic card D2 as well as the center line C0 and the trajectory C1 of the receiver 23.

In FIG. 10, each hatched area R indicates an area where the determination value N="LH" is obtained, within an inside area of each plastic card D2 of which side edges are shown by a closed thick solid line. More specifically, with respect to a positional relationship between the ultrasonic sensor 20 and each plastic card D2, when the receiver 23 is positioned in the area R, the determination value N is "LH." Meanwhile, when the receiver 23 is positioned in an area other than the area R, the determination value N is a different value from "LH."

In order for the reception intensity of the diffracted wave received during the second measurement period M2 to be a value corresponding to "H," as shown in FIG. 10, the ultrasonic sensor 20 and the plastic card D2 (or the business card) are in a limited positional relationship. In FIG. 10, a position X1 is a position of the receiver 23 at a time when the roller rotation quantity is the first specific quantity. A position X3 is a position of the receiver 23 at a time when the roller rotation quantity is the third specific quantity. A position of the receiver 23 at a time when the ultrasonic wave is emitted in S310 corresponds to an intersection between a dotted line indicating the trajectory C1 of the receiver 23 and an alternate long and short dash line corresponding to the position X1.

As understood from FIG. 10, when the plastic card D2 is fed in a skewed state, even though the determination value N acquired in response to the ultrasonic wave being first emitted in S310 is "LH," the determination value N acquired in response to the ultrasonic wave being later emitted in S410 every particular period of time is not "LH."

Specifically, in a case (see the area (II) of FIG. 10) where the plastic card D2 is skewed counterclockwise in such a manner that a leading end thereof in the feeding direction is inclined in a direction toward the trajectory C1 of the receiver 23 from the center line C0, when a trailing end portion of the plastic card D2 in the feeding direction passes the receiver 23, a distance between the receiver 23 and a left side edge of the plastic card D2 in FIG. 10 becomes shorter. Thus, when the distance between the receiver 23 and the left side edge of the plastic card D2 in FIG. 10 is short, a diffracted wave easily reaches the receiver 23. Therefore, a reception intensity of an ultrasonic wave, which is received by the receiver 23 in response to the ultrasonic wave being emitted by the emitter 21 in this situation, is high. More specifically, since the diffracted wave reaches the receiver 23 earlier, a part of the diffracted wave is received by the receiver 23 in the first measurement period M1. Thereby, in this situation, the determination value N="HH" is obtained.

Meanwhile, in a case (see the area (III) of FIG. 10) where the plastic card D2 is skewed clockwise in such a manner that the leading end thereof in the feeding direction is inclined in a direction toward an opposite side of the trajectory C1 of the receiver 23 from the center line C0, when the trailing end portion of the plastic card D2 in the feeding direction passes the receiver 23, the distance between the receiver 23 and the left side edge of the plastic card D2 in FIG. 10 becomes longer. Thus, when the distance between the receiver 23 and the left side edge of the plastic card D2 in FIG. 10 is long, it is difficult for the diffracted wave to reach the receiver 23. Therefore, a reception intensity of an ultrasonic wave, which is received by the receiver 23 in response to the ultrasonic wave being emitted by the emitter 21 in this situation, is low. More specifically, since the diffracted wave reaches the receiver 23 later, it is impossible to receive the diffracted wave even in the second measurement period M2. Thus, in this situation, the determination value N="LL" is obtained.

For the aforementioned reasons, in S480, the counterclockwise skew flag is switched to "ON." Further, in S500, the clockwise skew flag is switched to "ON." After starting the state determining process in S140, as shown in FIG. 8, the controller 10 determines whether the abnormality flag has been switched to "ON" (S150). In response to determining that the abnormality flag has been switched to "ON" (S150: Yes), the controller 10 goes to S230. Meanwhile, in response to determining that the abnormality flag is still "OFF" (S150: No), the controller 10 determines whether the roller rotation quantity has become a second specific quantity (S160). In response to determining that the roller rotation quantity has not become the second specific quantity (S160: No), the controller 10 goes back to S150.

The second specific quantity is a roller rotation quantity for a leading end of a scanning target area of the document sheet D in the feeding direction to be conveyed to the document scanning position where the scanning device 60 performs image scanning Specifically, when a roller rotation quantity quantified since the output signal from the rear sensor 50R has been switched to the ON signal reaches a particular quantity, the controller 10 determines that the roller rotation quantity has become the second specific quantity.

When the roller rotation quantity has reached the second specific quantity in a state where the abnormality flag is still "OFF" (S160: Yes), the controller 10 begins to control the scanning device 60 to perform image scanning in accordance with operational conditions depending on the sheet type (S170). The operational conditions include a condition that specifies a scanning area of the document sheet D. Specifically, the controller 10 inputs an instruction into the scanning device 60, thereby controlling the scanning device 60 to start scanning the document sheet D that has reached the document scanning position after passing by the rear sensor 50R. Thereby, both sides of the document sheet D are scanned, and scanned image data of the both sides are generated.

After starting the document scanning, the controller 10 determines whether the abnormality flag has been switched to "ON" (S180). In response to determining that the abnormality flag is still "OFF" (S180: No), the controller 10 determines whether document scanning by the scanning device 60 has been all completed (S190). In response to determining that the document scanning by the scanning device 60 has not been completed (S190: No), the controller 10 goes back to S180.

When the document scanning by the scanning device 60 has been all completed with the abnormality flag being still "OFF" (S190: No), the controller 10 determines whether one of the clockwise skew flag and the counterclockwise skew flag is set to "ON" (S200).

In response to determining that one of the clockwise skew flag and the counterclockwise skew flag is set to "ON" (S200: Yes), the controller 10 outputs scanned image data, all of which has been generated along with completion of the document scanning, after skew correction (S210). In S210, the controller 10 performs the skew correction for the scanned image data by rotating the scanned image in such a rotational direction as to correct skewing of the scanned image.

In S210, in order to output appropriate scanned image data, the controller 10 may perform image processing, other than the skew correction, for the scanned image data. The controller 10 may output the scanned image data, e.g., by transmitting the scanned image data to an external device via the communication I/F 90. The controller 10 may output the scanned image data, e.g., by storing the scanned image data as data for storage into the RAM 15 or the EEPROM 17. After completion of S210, the controller 10 terminates the ADF scanning process.

In response to determining that the clockwise skew flag and the counterclockwise skew flag are set to "OFF" (S200: No), the controller 10 outputs scanned image data without implementing skew correction for the scanned image data (S220). In S220, the controller 10 may perform image processing for outputting appropriate scanned image data, in the same manner as executed in S210. The controller 10 may output the scanned image data, e.g., by transmitting the scanned image data to an external device via the communication I/F 90. The controller 10 may output the scanned image data, e.g., by storing the scanned image data as data for storage into the RAM 15 or the EEPROM 17. After completion of S220, the controller 10 terminates the ADF scanning process.

In response to determining that the abnormality flag has been switched to "ON" (S180: Yes), the controller 10 goes to S230. In S230, the controller 10 performs an error process. As the error process, the controller 10 may control the display of the user I/F 80 to display an error message showing occurrence of an error/abnormality and a type of the error/abnormality. As the error process, the controller 10 may control the feeder 70 to stop document feeding. After execution of the error process in S230, the controller 10 terminates the ADF scanning process.

As described above, according to the illustrative embodiment, the image scanner 1 determines the feeding state of a document sheet D, using differences in how an ultrasonic wave propagates from the emitter 21 to the receiver 23 depending on a state of the document sheet D between the emitter 21 and the receiver 23. Specifically, the image scanner 1 determines the feeding state of the document sheet D based on a reception intensity (a peak hold value) of an ultrasonic wave received by the receiver 23 during each of a plurality of periods of time (e.g., the first measurement period M1 and the second measurement period M2) in response to the ultrasonic wave being emitted by the emitter 21.

In particular, according to the illustrative embodiment, the image scanner 1 measures a reception intensity of a direct wave received during the first measurement period M1 and a reception intensity of a diffracted wave received during the second measurement period M2. Therefore, based on a determination value N representing the reception intensities, it is possible to properly determine a type and a size of the document sheet D and occurrence of multi-feed.

Thus, according to the image scanner 1 of the illustrative embodiment, using the ultrasonic sensor 20, it is possible to determine the type and the size of the document sheet D as well as occurrence of multi-feed. Namely, the image scanner 1, which is configured to feed a plurality of types of document sheets D, is allowed to discriminate various feeding states including multi-feed, using ultrasonic waves. Thus, according to the illustrative embodiment, it is possible to provide the high-performance image scanner 1.

Further, according to the illustrative embodiment, when one or more plastic cards D2 are fed as document sheets D, by repeatedly determining the feeding state of each plastic card D2 based on the determination value N acquired in response to an ultrasonic wave being emitted every particular period of time, it is possible to determine whether each plastic card D2 is fed in a skewed state and in which direction (clockwise or counterclockwise) each plastic card D2 is skewed.

Thus, according to the illustrative embodiment, the image scanner 1 is allowed to easily and properly perform skew correction for scanned image data of each plastic card D2. In general, regarding ADF scanning, regular papers D1 are less likely to be fed in a skewed state, owing to a guide mechanism of the feeding path 73. Further, since business cards are so flexible, the business cards are not fed in a skewed state as frequently as the plastic cards D2. Regarding the regular papers D1 and the business cards, when they are hardly fed in a skewed state, there is no need to perform skew correction for them. Nonetheless, when they are fed in a skewed state, skew correction may be performed for them. There is a known technique to detect a skewed document sheet based on an inclination of a side edge of the document sheet. In the illustrative embodiment, when the sheet type of a document sheet D is "regular paper" or "business card," the image scanner 1 may, in S220, detect skewing of the document sheet D by analyzing scanned image data of the document sheet D using the known technique, and perform skew correction for the scanned image data of the document sheet D.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiment of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

(Modifications)

In the aforementioned illustrative embodiment, when the reception intensity of the diffracted wave received during the second measurement period M2 that is represented by the determination value N acquired in S320 is "H," the controller 10 determines whether the sheet type of the document sheet D is "business card" or "plastic card" based on whether the reception intensity of the direct wave received during the first measurement period M1 is "H" or "L" (see S370 to S390). For instance, this technique may be applied to an image scanner that is not configured to feed a plastic card D2. In this case, it is possible to determine whether the sheet type of the document sheet D is "thin business card" or "thick business card," based on whether the reception intensity of the direct wave received during the first measurement period M1 is "H" or "L." Likewise, this technique may be applied to a case where a business card is not fed, but a plastic card D2 is fed. In this case, it is possible to determine whether the sheet type of the document sheet D is "thin plastic card" or "thick plastic card," based on whether the reception intensity of the direct wave received during the first measurement period M1 is "H" or "L." Thus, the technique to execute the steps S370 to S390 may be used to determine not only a material but also a thickness of the document sheet D.

In the aforementioned illustrative embodiment, the image scanner 1 is configured to determine the state of the document sheet D in the detectable area, based on the reception intensities measured in the two measurement periods M1 and M2. However, the image scanner 1 may be configured to determine the state of the document sheet D in the detectable area, based on a combination of reception intensities measured in three or more measurement periods. For instance, a time when the receiver 23 receives a diffracted wave is different depending on the size of the document sheet D. Accordingly, by setting for each size of the document sheet D a measurement period M2 for measuring a reception intensity of a diffracted wave, it is possible to determine a more specific size of the document sheet D.

The aforementioned illustrative embodiment provides an example in which aspects of the present disclosure are applied to the image scanner 1 configured to feed a document sheet D in such a manner as to put the center line C0 of the document sheet D to be coincident with the feeding center of the feeding path 73. However, aspects of the present disclosure may be applied to an image scanner configured to feed a document sheet D in such a manner as to put a left end and/or a right end of the document sheet D to be coincident with a left end and/or a right end of the feeding path 73.

The ultrasonic sensor 20 may not be disposed in a position away from the center line C0 of the document sheet D. Even though the ultrasonic sensor 20 is not disposed in a position away from the center line C0 of the document sheet D, a mode in which the receiver 23 receives a diffracted wave when the document sheet D is fed in a skewed state changes depending on a change of a distance between the ultrasonic sensor and the left end or the right end of the document sheet D. By specifying the change from analysis of the reception intensity, it is possible to determine whether the document sheet D is fed in a skewed state.

The above function of the image scanner 1 to determine the feeding state of the document sheet D may be applied to various types of electronic devices configured to perform sheet feeding. For instance, the function may be applied to an image forming apparatus such as an inkjet printer configured to feed a sheet and form an image on the sheet.

The comparator circuit 45 and the output circuit 47 may not be included in the measurement-determination unit 40. Instead, the measurement-determination unit 40 may include an analog-digital convertor, and may be configured to convert a peak hold value into a digital value by the analog-digital convertor and transmit the digital value to the controller 10. In this case, the controller 10 may be configured to achieve equivalent functions of the comparator circuit 45 and the output circuit 47, e.g., by executing programs stored in the ROM 13.

The propagation velocity of the ultrasonic wave depends on temperature. Accordingly, the image scanner 1 may include a temperature sensor around the ultrasonic sensor 20. In this case, the image scanner 1 may be configured to shift the measurement periods M1 and M2 to appropriately receive the direct wave and the diffracted wave, based on a temperature detected by the temperature sensor.

A function of each single element included in the image scanner 1 of the aforementioned illustrative embodiment may be dispersedly provided to a plurality of elements. Functions of a plurality of elements included in the image scanner 1 of the aforementioned illustrative embodiment may be provided to a single element in an integrated manner. Some of elements included in the image scanner 1 of the aforementioned illustrative embodiment may be omitted.

With respect to associations of elements exemplified in the aforementioned illustrative embodiment with elements to be defined according to aspects of the present disclosure, the feeding path 73 may be an example of a sheet guide according to aspects of the present disclosure. The peak hold circuit 43 may be an example of a measurer according to aspects of the present disclosure. The controller 10 may be an example of a controller according to aspects of the present disclosure. More specifically, the CPU 11 executing one or more programs 13A stored in the ROM 13 may be an example of the controller according to aspects of the present disclosure. Further, the sensor driver 30 may be included in the controller according to aspects of the present disclosure. Furthermore, the comparator circuit 45 and the output circuit 47 may be included in the controller according to aspects of the present disclosure.

What is claimed is:

1. A sheet feeder comprising:

a sheet guide;

an emitter disposed to face a first side of a sheet being fed along the sheet guide, the emitter being configured to emit ultrasonic waves;

a receiver opposed to the emitter across the sheet guide, the receiver being disposed to face a second side of the sheet being fed along the sheet guide, the second side being an opposite side of the first side, the receiver being configured to receive the ultrasonic waves;

a measurer configured to measure reception intensities of the ultrasonic waves received by the receiver; and a controller configured to perform a state determining process comprising:

controlling the emitter to emit an ultrasonic wave toward a target sheet being fed along the sheet guide;

in response to the emission of the ultrasonic wave, controlling the measurer to measure a first reception intensity of a first component of the ultrasonic wave received by the receiver during a first period of time;

controlling the measurer to measure a second reception intensity of a second component of the ultrasonic wave received by the receiver during a second period of time after the first period of time; and determining a feeding state of the target sheet in a detectable area between the emitter and the receiver within the sheet guide, based on the first reception intensity of the first component received during the first period of time and the second reception intensity of the second component received during the second period of time;

wherein the first component is a direct wave that reaches the receiver after being transmitted through the target sheet, and the second component is a diffracted wave that reaches the receiver after detouring around the target sheet.

2. The sheet feeder according to claim 1, wherein the sheet guide is configured to guide therealong a first sheet and a second sheet, the second sheet being smaller in size than the first sheet, and wherein the state determining process further comprises:

specifying one of a plurality of predetermined states as the feeding state of the target sheet, based on the first reception intensity and the second reception intensity, the plurality of predetermined states including:

a first state in which the first sheet is fed alone without overlapping any other sheet;

a second state in which the first sheet is fed in a manner overlapping one or more other sheets; and a third state in which the second sheet is fed.

3. The sheet feeder according to claim 2, wherein the state determining process further comprises:

specifying the first state as the feeding state of the target sheet when the first reception intensity is higher than a first threshold value, and the second reception intensity is equal to or lower than a second threshold value, the second threshold value being equal to or higher than the first threshold value;

specifying the second state as the feeding state of the target sheet when the first reception intensity is equal to or lower than the first threshold value, and the second reception intensity is equal to or lower than the second threshold value; and specifying the third state as the feeding state of the target sheet when the second reception intensity is higher than the second threshold value.

4. The sheet feeder according to claim 3, wherein the state determining process further comprises:

when the second reception intensity is higher than the second threshold value, determining a sheet type of the second sheet based on the first reception intensity.

5. The sheet feeder according to claim 3, wherein the state determining process further comprises:

when the first reception intensity is equal to or lower than the first threshold value, and the second reception intensity is higher than the second threshold value, specifying the third state as the feeding state of the target sheet, and determining that the second sheet is a plastic card.

6. The sheet feeder according to claim 3, wherein the state determining process further comprises:

when the first reception intensity is higher than the first threshold value, and the second reception intensity is higher than the second threshold value, specifying the third state as the feeding state of the target sheet, and determining that the second sheet is a paper card.

7. The sheet feeder according to claim 3, wherein the receiver is disposed to receive the ultrasonic waves in a detection position, the detection position being a particular distance away from a center line of the sheet that extends along a feeding direction of the sheet, in a width direction perpendicular to the feeding direction, and wherein the state determining process further comprises:

controlling the emitter to emit a subsequent ultrasonic wave at a point of time when the target sheet has been conveyed over a particular distance since the emission of the ultrasonic wave or at a point of time when a particular period of time has elapsed since the emission of the ultrasonic wave;

in response to the emission of the subsequent ultrasonic wave, controlling the measurer to measure a specific reception intensity of a specific component of the subsequent ultrasonic wave received by the receiver during each of a plurality of specific periods of time;

when the third state is specified as the feeding state of the target sheet based on the first reception intensity and the second reception intensity, determining whether the second sheet is fed in a skewed state, based on the plurality of specific reception intensities measured during the plurality of specific periods of time in response to the emission of the subsequent ultrasonic wave;

when a first specific reception intensity measured during a first specific period of time of the plurality of specific periods of time is higher than the first threshold value, and a second specific reception intensity measured during a second specific period of time, after the first specific period of time, of the plurality of specific periods of time is higher than the second threshold value, determining that the second sheet is skewed in such a manner that a leading end of the second sheet in the feeding direction is inclined in a first direction toward the detection position from the center line; and when the first specific reception intensity measured during the first specific period of time is equal to or lower than the first threshold value, and the second specific reception intensity measured during the second specific period of time is equal to or lower than the second threshold value, determining that the second sheet is skewed in such a manner that the leading end of the second sheet in the feeding direction is inclined in a second direction opposite to the first direction.

8. The sheet feeder according to claim 7, wherein the state determining process further comprises:

when the first state is specified as the feeding state of the target sheet based on the first reception intensity and the second reception intensity, determining whether the first sheet is fed in the second state, based on the plurality of specific reception intensities measured during the plurality of specific periods of time in response to the emission of the subsequent ultrasonic wave.

9. The sheet feeder according to claim 2, wherein the state determining process further comprises:

controlling the emitter to emit a subsequent ultrasonic wave at a point of time when the target sheet has been conveyed over a particular distance since the emission of the ultrasonic wave or at a point of time when a particular period of time has elapsed since the emission of the ultrasonic wave;

in response to the emission of the subsequent ultrasonic wave, controlling the measure to measure a specific reception intensity of a specific component of the subsequent ultrasonic wave received by the receiver during each of a plurality of specific periods of time; and when the third state is specified as the feeding state of the target sheet based on the first reception intensity and the second reception intensity, determining whether the second sheet is fed in a skewed state, based on the plurality of specific reception intensities measured during the plurality of specific periods of time in response to the emission of the subsequent ultrasonic wave.

10. The sheet feeder according to claim 9, wherein the state determining process further comprises:

when the first state is specified as the feeding state of the target sheet based on the first reception intensity and the second reception intensity, determining whether the first sheet is fed in the second state, based on the plurality of specific reception intensities measured during the plurality of specific periods of time in response to the emission of the subsequent ultrasonic wave.

11. The sheet feeder according to claim 1, wherein the controller comprises:

a processor; and a memory storing processor-executable instructions configured to, when executed by the processor, cause the processor to perform the state determining process.

12. A method implementable on a processor coupled with a sheet feeder, the sheet feeder comprising a sheet guide, an emitter, a receiver, and a measurer, the method comprising:

controlling the emitter to emit an ultrasonic wave toward a target sheet being fed along the sheet guide;

in response to the emission of the ultrasonic wave, controlling the measurer to measure a first reception intensity of a first component of the ultrasonic wave received by the receiver during a first period of time;

controlling the measurer to measure a second reception intensity of a second component of the ultrasonic wave received by the receiver during a second period of time after the first period of time; and determining a feeding state of the target sheet in a detectable area between the emitter and the receiver within the sheet guide, based on the first reception intensity of the first component received during the first period of time and the second reception intensity of the second component received during the second period of time;

wherein the first component is a direct wave that reaches the receiver after being transmitted through the target sheet, and the second component is a diffracted wave that reaches the receiver after detouring around the target sheet.

13. A non-transitory computer-readable medium storing computer-readable instructions that are executable by a processor coupled with coupled with a sheet feeder, the sheet feeder comprising a sheet guide, an emitter, a receiver, and a measurer, the instructions being configured to, when executed by the processor, cause the processor to:

control the emitter to emit an ultrasonic wave toward a target sheet being fed along the sheet guide;

in response to the emission of the ultrasonic wave, control the measurer to measure a first reception intensity of a first component of the ultrasonic wave received by the receiver during a first period of time;

control the measurer to measure a second reception intensity of a second component of the ultrasonic wave received by the receiver during a second period of time after the first period of time; and determine a feeding state of the target sheet in a detectable area between the emitter and the receiver within the sheet guide, based on the first reception intensity of the first component received during the first period of time and the second reception intensity of the second component received during the second period of time;

wherein the first component is a direct wave that reaches the receiver after being transmitted through the target sheet, and the second component is a diffracted wave that reaches the receiver after detouring around the target sheet.

* * * * *